United States Patent [19]

Cormier, Sr. et al.

[11] Patent Number: 5,049,173

[45] Date of Patent: Sep. 17, 1991

[54] PRODUCTION OF ULTRA-HIGH PURITY OXYGEN FROM CRYOGENIC AIR SEPARATION PLANTS

[75] Inventors: Thomas E. Cormier, Sr.; Rakesh Agrawal, both of Allentown, Pa.; Alan L. Prentice, Surbiton, England; Donald W. Woodward, New Tripoli, Pa.

[73] Assignee: Air Products and Chemicals, Inc., Allentown, Pa.

[21] Appl. No.: 490,017

[22] Filed: Mar. 6, 1990

[51] Int. Cl.[5] ..... F25J 3/04; F25J 3/02

[52] U.S. Cl. ..... 62/24; 62/22; 62/27; 62/38; 62/39

[58] Field of Search ..... 62/22, 24, 27, 28, 32, 62/36, 38, 39, 42, 44

[56] References Cited

U.S. PATENT DOCUMENTS

| | | | |
|---|---|---|---|
| 3,688,513 | 9/1972 | Streich et al. | 62/22 |
| 4,137,056 | 1/1979 | Golovko | 62/22 X |
| 4,568,528 | 2/1986 | Cheung | 62/22 X |
| 4,575,388 | 3/1986 | Okada | 62/22 |
| 4,707,994 | 11/1987 | Shenoy et al. | 62/38 X |
| 4,715,874 | 12/1987 | Erickson | 62/38 |
| 4,747,860 | 5/1988 | Atkinson | 62/22 |
| 4,781,739 | 11/1988 | Erickson | 62/22 |
| 4,783,208 | 11/1988 | Rathbone | 62/22 |
| 4,824,453 | 4/1989 | Rottmann et al. | 62/22 |
| 4,843,828 | 7/1989 | Gladman | 62/27 X |
| 4,853,015 | 8/1989 | Yoshino | 62/24 X |
| 4,854,954 | 8/1989 | Erickson | 62/38 X |
| 4,867,772 | 9/1989 | Eyre | 62/24 |
| 4,869,742 | 9/1989 | Thorogood et al. | 62/39 X |
| 4,871,382 | 10/1989 | Thorogood et al. | 62/24 X |
| 4,916,908 | 4/1990 | Lavin et al. | 62/24 X |

*Primary Examiner*—Henry A. Bennett
*Assistant Examiner*—Christopher B. Kilner
*Attorney, Agent, or Firm*—Willard Jones, II; William F. Marsh; James C. Simmons

[57] ABSTRACT

The present invention relates to an improvement for the production of ultra-high purity oxygen from cryogenic air separation processes which produce nitrogen and/or commercial purity oxygen products. In particular, the improvement comprises removing or producing an oxygen-containing but heavy contaminant-lean (free, stream from one of the distillation columns of a single or multiple column cryogenic air separation facility and further stripping the removed or produced oxygen-containing stream in a fractionator to produce ultra-high purity oxygen (i.e., contaminant concentration <10 vppm).

16 Claims, 13 Drawing Sheets

PRODUCTION OF ULTRA-HIGH PURITY OXYGEN FROM CRYOGENIC AIR SEPARATION PLANTS

TECHNICAL FIELD

The present invention is related to a process for the cryogenic distillation of air or oxygen/nitrogen mixtures to produce nitrogen and/or commercial purity oxygen and small quantities of ultra-high purity oxygen.

BACKGROUND OF THE INVENTION

Numerous processes are known in the art for the production of an ultra-high purity oxygen product stream by using cryogenic distillation; among these are the following:

U.S. Pat. No. 3,363,427 discloses a process for the production of ultra-high purity oxygen from a commercial grade oxygen stream, which typically has an oxygen concentration of about 99.5–99.8 vol %, a small amount of argon as a light impurity and small quanities of heavier impurities consisting of a variety of hydrocarbons (mainly methane), krypton and xenon. In the process, hydrocarbons are either removed by combustion in a catalytic chamber or as purge liquid from an auxiliary distillation column. When a catalytic combustion unit is not used, multiple distillation columns are used with various heat exchangers and reboiler/condensers to effectuate the separation. In this operating mode, refrigeration to the system is provided by either importing liquid nitrogen from an external source or using a nitrogen stream from the air separation unit that is recycled back to the air separation unit, thus transferring refrigeration from one point to another. This catalytic combustion option requires an additional compressor and heat exchangers.

U.S. Pat. No. 4,560,397 discloses a process to produce ultra-high purity oxygen and a high pressure nitrogen by cryogenic distillation of air. In the process, the feed air is fractionated in a high pressure column producing a nitrogen product stream, which is removed from the top of the high pressure column, and a crude liquid oxygen stream, which is removed from the bottom of the high pressure column. This crude liquid oxygen stream is laden with all the heavy impurities contained in the feed air and also contains a majority of the argon contained in the feed air. A portion of this crude liquid oxygen stream is distilled in a secondary lower pressure column to produce a so called ultra-high purity oxygen. Since all the heavy impurities will travel with the oxygen downward in this secondary column, it is impossible to produce a liquid oxygen product with trace low concentrations of impurities directly from this column. To overcome this problem, a gaseous oxygen product is removed at a point at least one equilibrium stage above the reboiler/condenser of this secondary column. Since, however, this vapor stream is in equilibrium with a liquid stream with high concentrations of heavies it is impossible to reduce the concentration of heavy impurities to the desired levels. For example, referencing the results cited in this patent, the concentration of methane in the so-called ultra-high purity oxygen is 8 vppm and of krypton is 1.3 vppm. By the ultra-high purity oxygen standards required specifically for electronic industry, these concentrations would be considered high; the typical hydrocarbon content of ultra-high purity oxygen for the electronic industry is less than 1 vppm.

U.S. Pat. No. 4,755,202 discloses a process to produce ultra-high purity oxygen from an air separation unit using double column cycle. In this process, an enriched oxygen containing stream (oxygen concentration range from 90.0 to 99.9%) is withdrawn from the bottom of the lower pressure column and is fed to a counter-current absorption column. In the absorption column, the ascending enriched oxygen containing stream is cleaned of heavier components by a descending liquid stream. A hydrocarbon-lean enriched oxygen containing stream is removed from the top of the absorption column and is subsequently condensed. A portion of this condensed hydrocarbon-lean stream is recyled as reflux to the absorption column, while the other portion is sent to a stripping column. In the stripping column, the descending hydrocarbon-lean liquid stream is stripped of the light components, such as argon, to produce an ultra-high purity liquid oxygen product at the bottom. A portion of the ultra-high purity liquid oxygen is reboiled to provide a vapor stream for the stripping column. This vapor stream is removed from the top of the stripper column and is recovered as a secondary product. In essence, this process has two undesirable features. The first is that by using a feed oxygen stream from the bottom of the low pressure column which is contaminated with both light and heavy impurities, two distillation columns are required to perform the separation (an absorption column and a stripping column). The second is that the process generates an oxygen containing vapor stream at the top of the stripping column which has an increased argon concentration; it is usually undesirable to have secondary oxygen product stream with decreased oxygen content.

U.S. Pat. No. 4,869,741 discloses a process to produce ultra-high purity oxygen. In the process, a liquid oxygen containing heavy and light contaminants is used as the feed stream. In the process, two distillation columns, three reboiler/condensers and a compressor on the recirculating nitrogen stream along with a main heat exchanger are used to effectuate the separation.

SUMMARY OF THE INVENTION

The present invention is an improvement of a conventional cryogenic air separation process for the production of quantities of ultra-high purtiy oxygen. The improvement of the present invention is applicable to any cryogenic process for the fractionation of air using a cryogenic distillation column system comprising at least one distillation column. In these processes, feed air is compressed, cooled to near its dew point and fed to the distillation column system for rectification thereby producing a nitrogen containing overhead and a crude liquid oxygen bottoms. The improvement, which is for producing an ultra-high purity oxygen product comprising the steps of: removing an oxygen-containing stream from a location of the distillation column where the removed stream is essentially free of heavier contaminants comprising hydrocarbons, carbon dioxide, xenon and krypton, and subsequently stripping the removed oxygen-containing stream in a cryogenic stripping/distillation column thereby producing an ultra-high purity oxygen product at the bottom of the cryogenic stripping/distillation column.

In the improvement of the present invention, the removed oxygen-containing stream to be stripped can be removed as either a liquid or a vapor stream. Also, the heat duty for reboiling the crogenic stripping/distillation column can be provided by subcooling at least a portion of the crude liquid oxygen bottoms from the distillation column of the cryogenic distillation column system, or by at least partially condensing a portion of the nitrogen overhead from the distillation column of the cryogenic distillation column system.

The improvement of the present invention is applicable to one, two and three distillation column systems. In the two column system, a feed air stream is compressed, cooled to near its dew point and fed to the high pressure distillation column system for rectification thereby producing a nitrogen containing overhead and a crude liquid oxygen bottoms and wherein the crude liquid oxygen is reduced in pressure, fed to and further fractionated in the low pressure distillation column thereby producing a low pressure nitrogen overhead. In the three column distillation system, a feed air stream is compressed, cooled to near its dew point and fed to the high pressure distillation column system for rectification thereby producing a nitrogen containing overhead and a crude liquid oxygen bottoms; wherein the crude liquid oxygen is reduced in pressure, fed to and further fractionated in the low pressure distillation column thereby producing a low pressure nitrogen overhead; and wherein an argon-containing side stream is removed from the low pressure column and rectified in the argon side-arm distillation column thereby producing a crude argon overhead and an enriched oxygen liquid which is returned to the low pressure column.

In the multiple column distillation systems, the oxygen-containing stream which is essentially free of heavier contaminants can be removed from any of the distillation columns.

Finally, the present invention is particularly suited to a nitrogen generator or single column system, wherein a feed air stream is compressed, cooled to near its dew point and fed to the distillation column system for rectification thereby producing a nitrogen containing overhead and a crude liquid oxygen bottoms. In this case, the improvement for producing an ultra-high purity oxygen product comprising the steps of: rectifying the crude liquid bottoms thereby producing an oxygen-containing stream which is essentially free of heavier contaminants comprising hydrocarbons, carbon dioxide, xenon and krypton, subsequently stripping the oxygen-containing stream in a cryogenic stripping/distillation column thereby producing an ultra-high purity oxygen product at the bottom of the cryogenic stripping/distillation column, and refluxing said cryogenic stripping-/distillation column with a liquid stream from the distillation column which is essentially free of heavier components comprising hydrocarbons, carbon dioxide, xenon and krypton. In this final embodiment, the preferred method for providing heat duty to reboil the crogenic stripping/distillation column is by condensing at least a portion of the oxygen-containing stream prior to distillation in the cryogenic stripping/distillation column.

DETAILED DESCRIPTION OF THE INVENTION

The present invention is an improvement to conventional air separation processes for the purpose of producing quanities of ultra-high purity oxygen. The improvement is in essence removing an oxygen-containing stream (either as a liquid or a vapor) from a location of one of the distillation columns of an air separation unit where the removed stream is essentially free of heavier components, such as hydrocarbons, carbon dioxide, xenon and krypton, and subsequently stripping that oxygen-containing stream to produce a ultra-high purity oxygen product. As can be seen the improvement does not work as a standalone unit, but its efficiency and cost effectiveness resides in its novel integration with a cryogenic air separation unit. The improvement is best described in reference to the following three general embodiments.

EMBODIMENT #1

The first embodiment essentially is a process for producing an ultra-high purity oxygen product by removing from a location of any fractionation column which is separating nitrogen and oxygen, of an air separation unit a side stream which contains some oxygen, yet is extremely lean in or devoid of heavy components, such as carbon dioxide, krypton, xenon and light hydrocarbons. The removed side stream can be removed as either a vapor or liquid. Such a location is typically several stages above the air feed to the high pressure column of a single or double column system or several stages above the crude liquid oxygen feed to a low pressure column of a two or three column system. This removed heavy contaminant-free oxygen containing stream is subsequently separated by stripping in an auxiliary distillation column to produce an ultra-high purity oxygen product at the bottom of such column.

As can be seen, the process of the present invention differs from the conventional ultra-high purity oxygen producing processes disclosed in the Background of the Invention section which all process an oxygen stream which is high in oxygen concentration yet not free of heavy contaminants. In these conventional processes, the oxygen feed stream must be processed to remove the heavy contaminants requiring at least one additional distillation column for this purpose.

This embodiment #1 of the present invention can be best understood in light of the following discussion of seven variations which are illustrated by the flowsheets in FIGS. 1–7. These flowsheets can be divided into two subcategories. The first subset draws an oxygen-containing but heavies-free liquid stream from the high pressure and/or the low pressure columns of a two column system and performs separation to recover ultra-high purity oxygen. The second subset draws an oxygen-containing but heavies-free vapor stream from the high pressure and/or the low pressure columns and performs a further separation on this stream to recover ultra-high purity oxygen. First the subset with liquid withdrawal will be discussed followed by a discussion of the vapor withdrawal subset.

Figure 1:
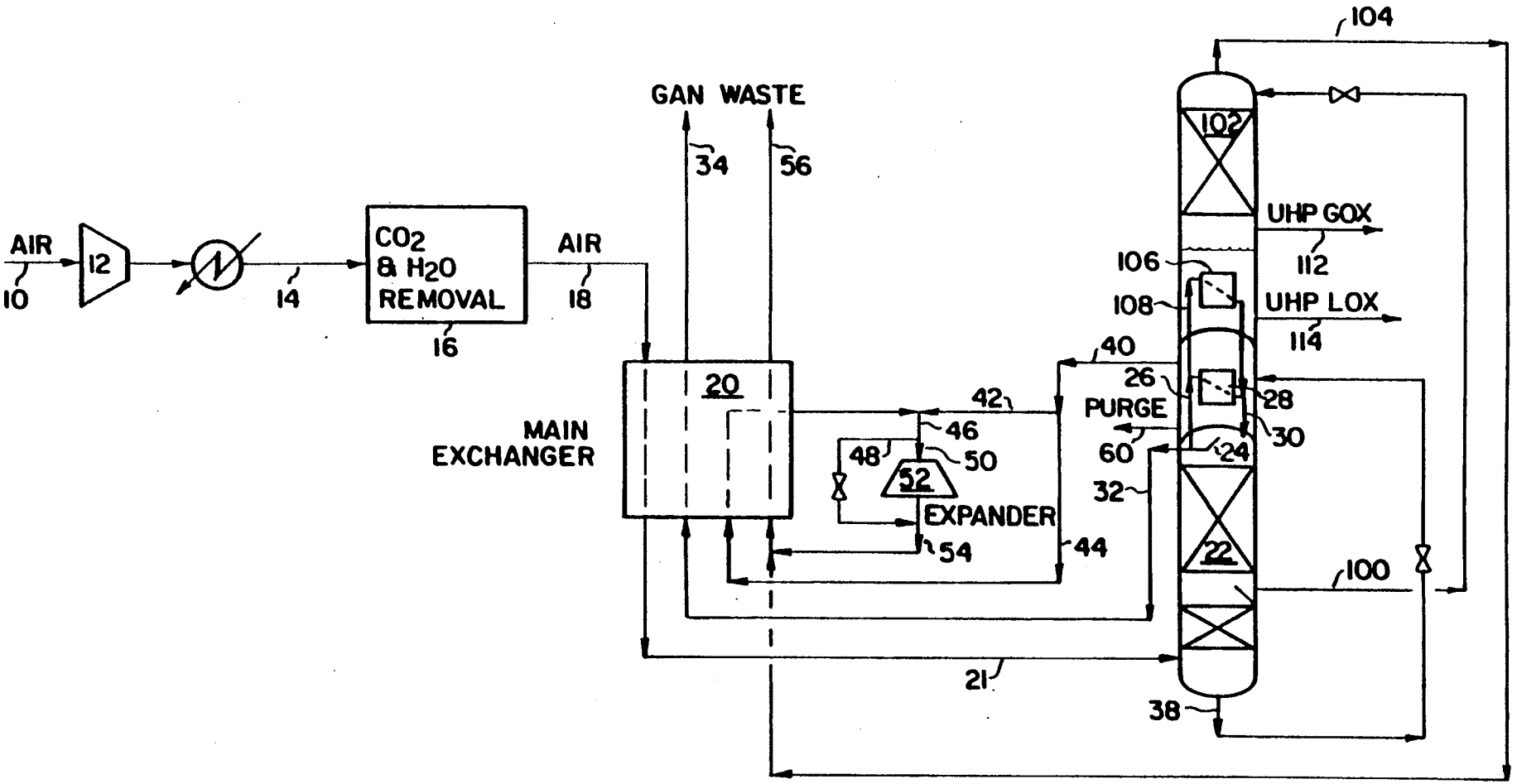
FIGS. 1–13 are schematic flowsheets of alternative embodiments of the process of the present invention.
Figure 2:
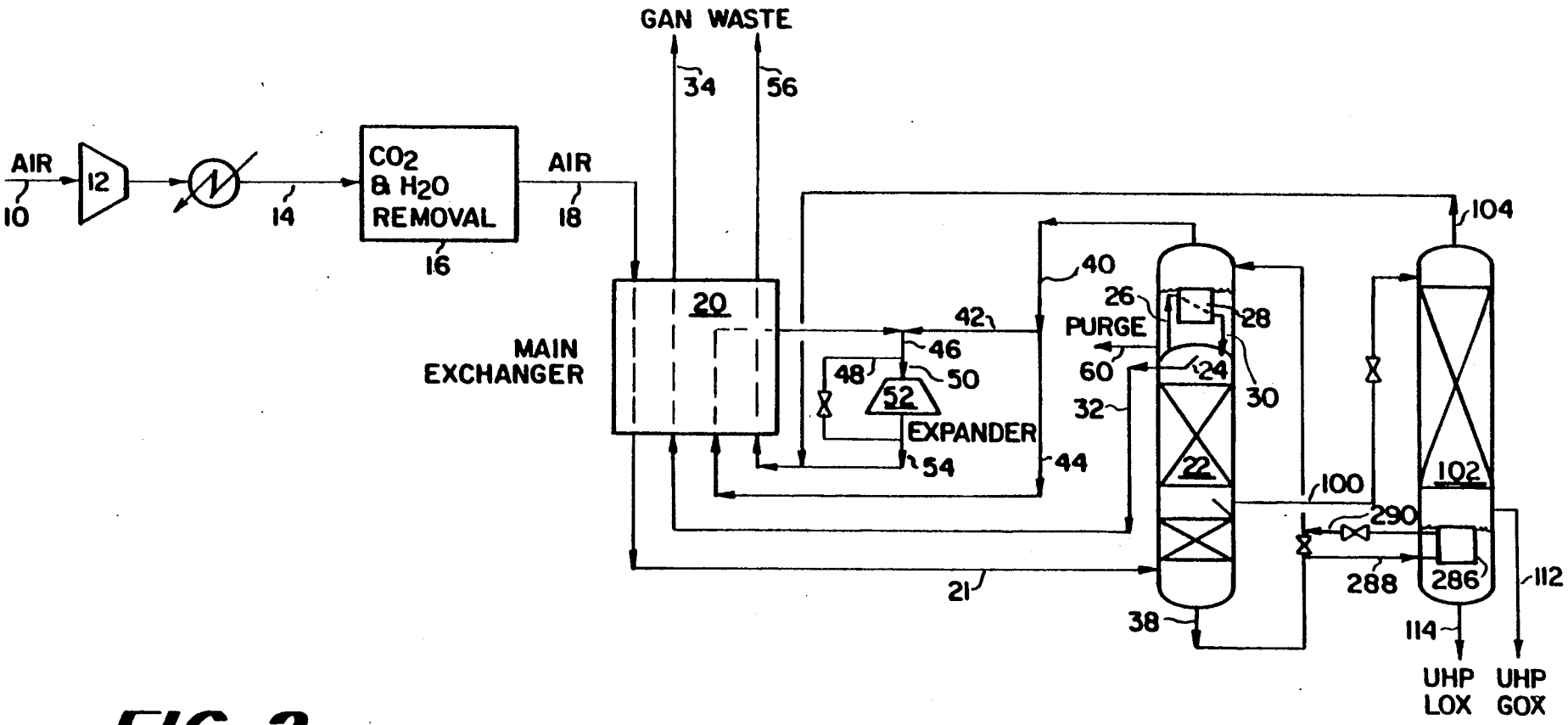

FIGS. 1 and 2 show flowsheets based on a liquid withdrawal from a high pressure column of a single column air separation unit. With reference to FIG. 1, a feed air stream is fed to main air compressor (MAC) 12 via line 10. After compression the feed air stream is aftercooled usually with either an air cooler or a water cooler, and then processed in unit 16 to remove any contaminants which would freeze at cryogenic temperatures, i.e., water and carbon dioxide. The processing to remove the water and carbon dioxide can be any known process such as an adsorption mole sieve bed. This compressed, water and carbon dioxide free, air is then fed to main heat exchanger 20 via line 18, wherein it is cooled to near its dew point. The cooled feed air stream is then fed to the bottom of rectifier 22 via line 21 for separation of the feed air into a nitrogen overhead stream and an oxygen-enriched bottoms liquid.

The nitrogen overhead is removed from the top of rectifier 22 via line 24 and is then split into two substreams. The first substream is fed via line 26 to reboiler/condenser 28 wherein it is liquefied and then returned to the top of rectifier 22 via line 30 to provide reflux for the rectifier. The second substream is removed from rectifier 22 via line 32, warmed in main heat exchanger 20 to provide refrigeration and removed from the process as a gaseous nitrogen product stream via line 34.

An oxygen-enriched liquid side stream is removed, via line 100, from an intermediate location of rectifier 22. The intermediate location is chosen such that the oxygen-enriched side stream has an oxygen concentration less than 35% and is essentially free of heavier components such as hydrocarbons, carbon dioxide, krypton and xenon. The oxygen-enriched side stream is then reduced is pressure across a valve and fed to fractionator 102 to be stripped thereby producing a stripper overhead and an ultra-high purity oxygen bottoms liquid. The stripper overhead is removed, via line 104, as a waste stream and warmed in heat exchanger 20 to recover refrigeration.

At least a portion of the ultra-high purity oxygen bottoms liquid is vaporized by indirect heat exchange in reboiler 106 thereby providing reboil to stripper 102. Heat duty for reboiler 106 is provided by condensing at least a portion, in line 108, of the nitrogen overhead from the top of rectifier 22 in line 26. After it has been condensed, it is recombined with the condensed nitrogen from condenser 28 and used as reflux for the high pressure column.

An ultra-high purity oxygen product is removed from the bottom of stripper 102. The product can be removed as a gaseous product via line 112 and/or a liquid product via line 114.

An oxygen-enriched bottoms liquid is removed from the bottom of rectifier 22 via line 38, reduced in pressure and fed to the sump surrounding reboiler/condenser 28 wherein it is vaporized thereby condensing the nitrogen overhead in line 26. The vaporized oxygen-enriched or waste stream is removed from the overhead of the sump area surrounding reboiler/condenser 28 via line 40.

This vaporized waste stream is then processed to recover refrigeration which is inherent in the stream. In order to balance the refrigeration provided to the process from the refrigeration inherent in the waste stream, stream 40 is split into two portions. The first portion is fed to main heat exchanger 20 via line 44 wherein it is warmed to recover refrigeration. The second portion is combined via line 42 with the warmed first portion in line 44 to form line 46. This recombined stream in line 46 is then split into two parts, again to balance the refrigeration requirements of the process. The first part in line 50 is expanded in expander 52 and then recombined with the second portion in line 48, after it has been let down in pressure across a valve, to form an expanded waste stream in line 54. This expanded waste stream is then fed to and warmed in main heat exchanger 20 to provide refrigeration and is then removed from the process as waste via line 56. To limit the number of streams passing through heat exchanger 20, the stripper waste stream in line 104 can be combined with the expanded waste stream from rectifier 22 in line 54.

Finally, a small purge stream is removed via line 60 from the sump surrounding reboiler/condenser 28 to prevent the build up of hydrocarbons in the liquid in the sump. If needed, a liquid nitrogen product is also recoverable as a fraction of the condensed nitrogen stream.

FIG. 2 is the identical process shown in FIG. 1 except that the heat duty for reboiling fractionator 102 is provided by subcooling a portion of the crude liquid oxygen from column 22 instead of condensing a portion of the nitrogen overhead from column 22. In FIG. 2, a portion of the crude liquid oxygen stream, in line 38, is fed, via line 288, to reboiler 286, located in the bottom of stripper 102. In reboiler 286, the portion is subcooled thereby providing the heat duty required to reboil stripper 102, subsequently reduced in pressure and recombined, via line 290, with the remaining portion of the crude liquid oxygen in line 38.

Figure 3:
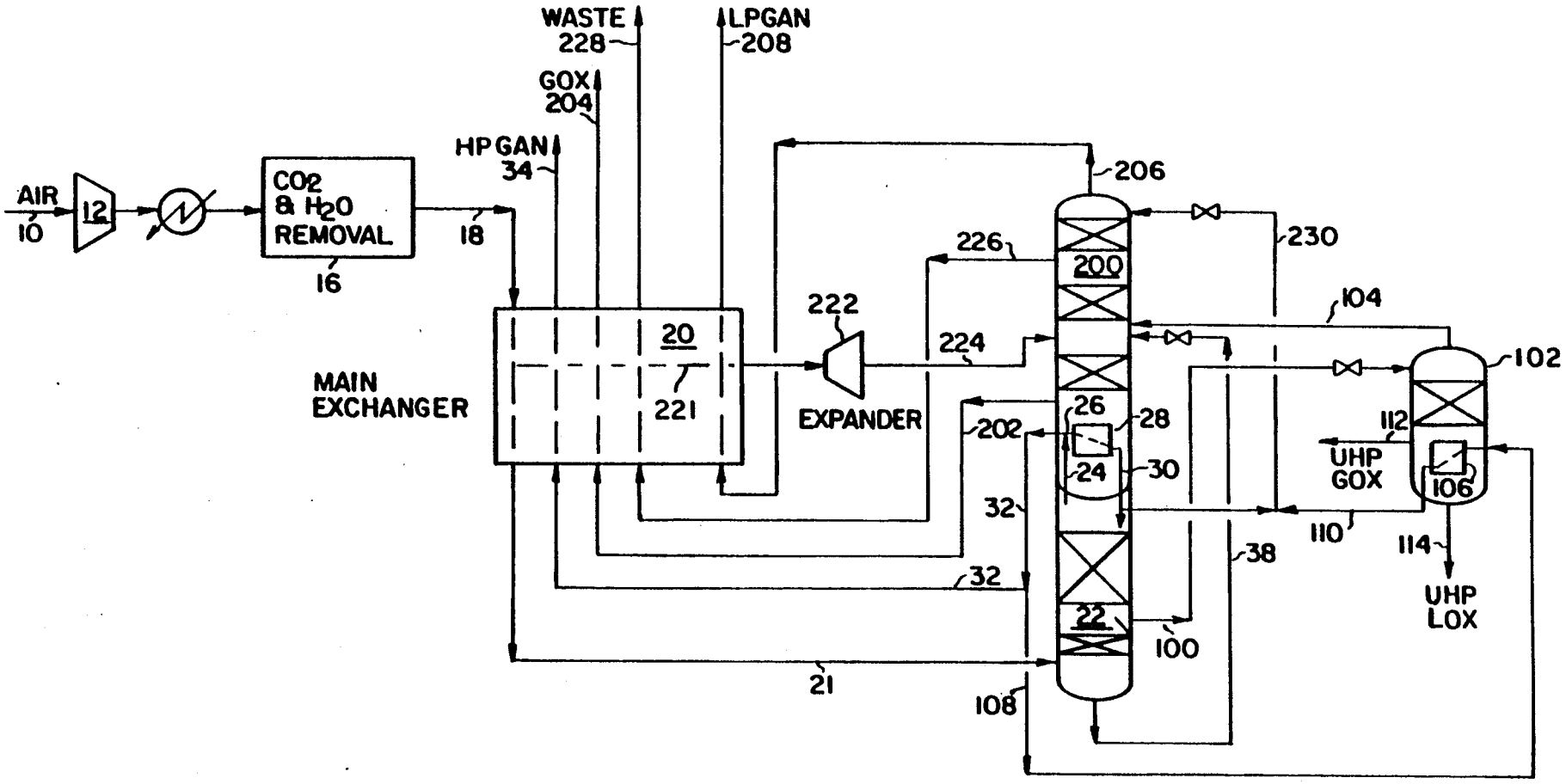

FIG. 3 is an extension of FIG. 1 when a double column air separation unit is used. With reference to the improvement portion of FIG. 3, an oxygen-enriched liquid side stream is removed, via line 100, from an intermediate location of rectifier 22. The intermediate location is chosen such that the oxygen-enriched side stream has an oxygen concentration from less than 35% and is essentially free of heavier components such as hydrocarbons. The oxygen-enriched side stream is then reduced in pressure across a valve and fed to fractionator 102 to be stripped thereby producing a stripper overhead and an ultra-high purity oxygen bottoms liquid. The stripper overhead is removed, via line 104, and fed to an intermediate location of the low pressure column 200. Even though in FIG. 3, the stripper overhead is shown as being fed to the low pressure column at the same location as oxygen-enriched bottom liquid from the high pressure column, it can be fed at any suitable location in the low pressure column. Preferably, it should be fed at a location where the composition of the vapor in the low pressure column is similar to the stripper overhead.

At the bottom of stripper 102, at least a portion of the ultra-high purity oxygen bottoms liquid is vaporized by indirect heat exchange in reboiler 106 thereby providing reboil to stripper 102. Heat duty for reboiler 106 is provided by condensing at least a portion, in line 108, of the nitrogen overhead from the top of rectifier 22. After it has been condensed, it is used as reflux for either the high or low pressure distillation columns; such as is shown by line 230.

An ultra-high purity oxygen product is removed from the bottom of stripper 102. The product can be removed as a gaseous product via line 112 and/or a liquid product via line 114.

As with FIGS. 1 and 2, there is nothing critical about the choice of provision for the heat duty required to reboil column 102. In addition to the choices shown in FIGS. 2 and 3, heat duty could be provided by condensing a portion of the feed air stream in place of high pressure nitrogen stream.

Figure 4:
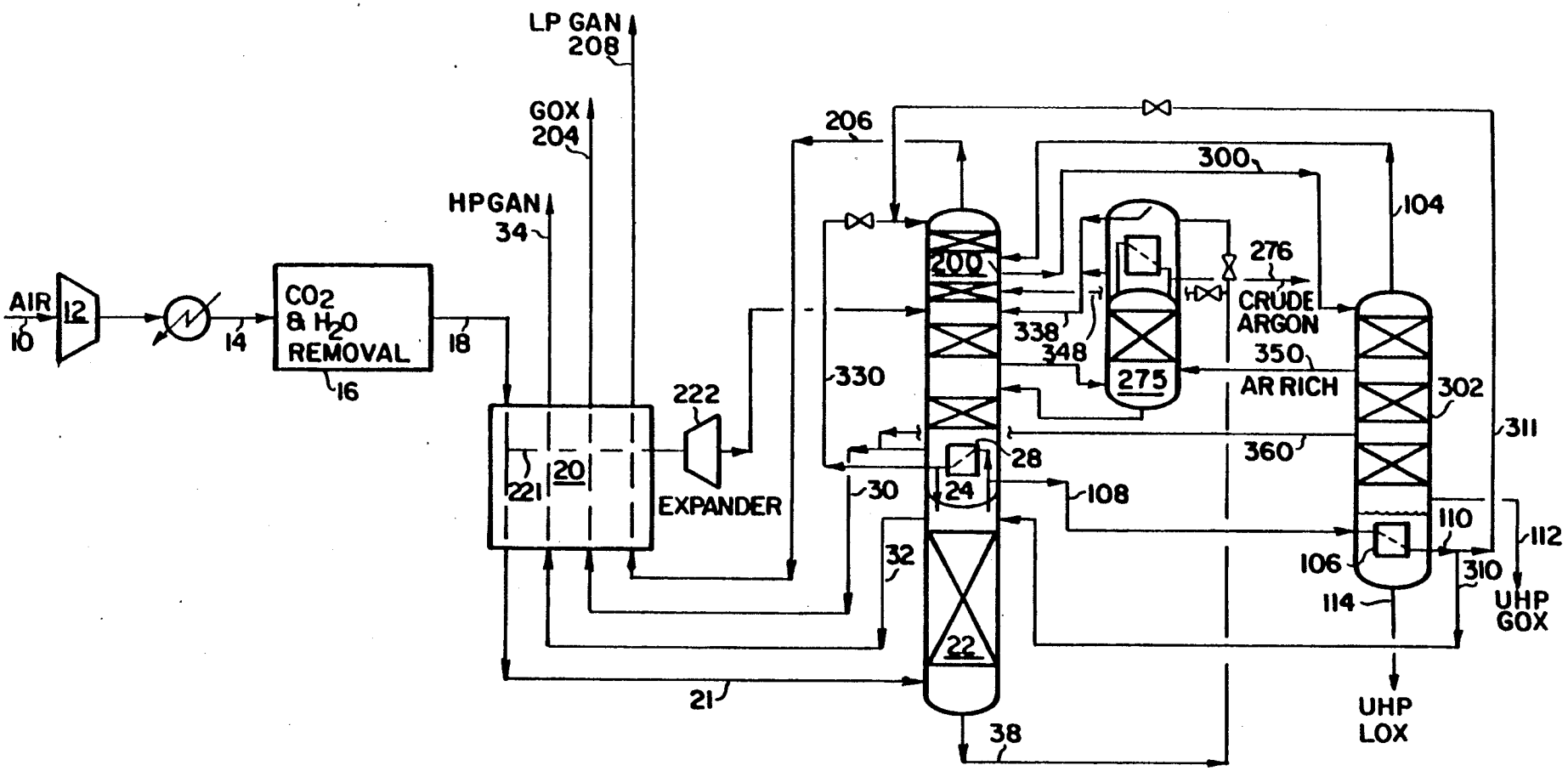

FIG. 4 illustrates the process of the present invention withdrawing a side stream from the low pressure column of a three-column air separation unit.

With reference to FIG. 4, a liquid stream is removed, via line 300, from the upper section of low pressure column 200 above the crude oxygen feed, lines 338 and 348, to low pressure column 200. This liquid stream in line 300 contains some oxygen, is lean on heavies, and is fed to the top of stripper 302. Column 302 can be reboiled by either high pressure gaseous nitrogen, via line 108, or a portion of the air feed from line 21. In addition, a small argon-rich side stream can be removed via line 350 fed to side arm column 275 producing crude argon via line 276. This cycle is useful for producing small quantities of ultra-high purity oxygen with no additional power requirements. Additionally, a side stream of normal purity gaseous oxygen can be removed via line 360 from stripper 302 several stages from the bottom to decrease L/V in this section and improve recovery of ultra-high purity oxygen. Withdrawal of streams 350 and 360 from stripper 302 is optional. Also, in FIG. 4, side arm column 275 is optional.

Figure 5:
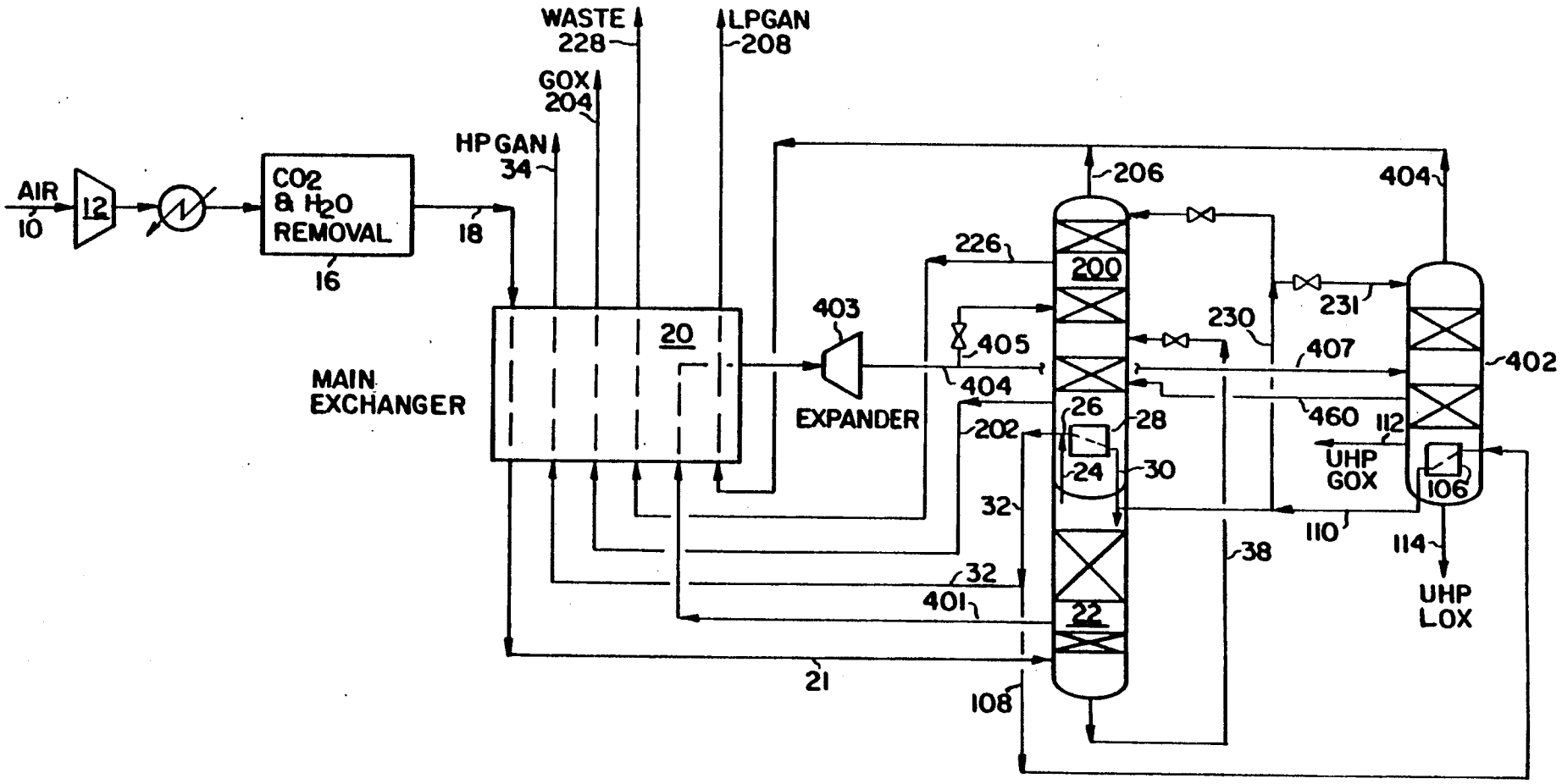
Figure 6:
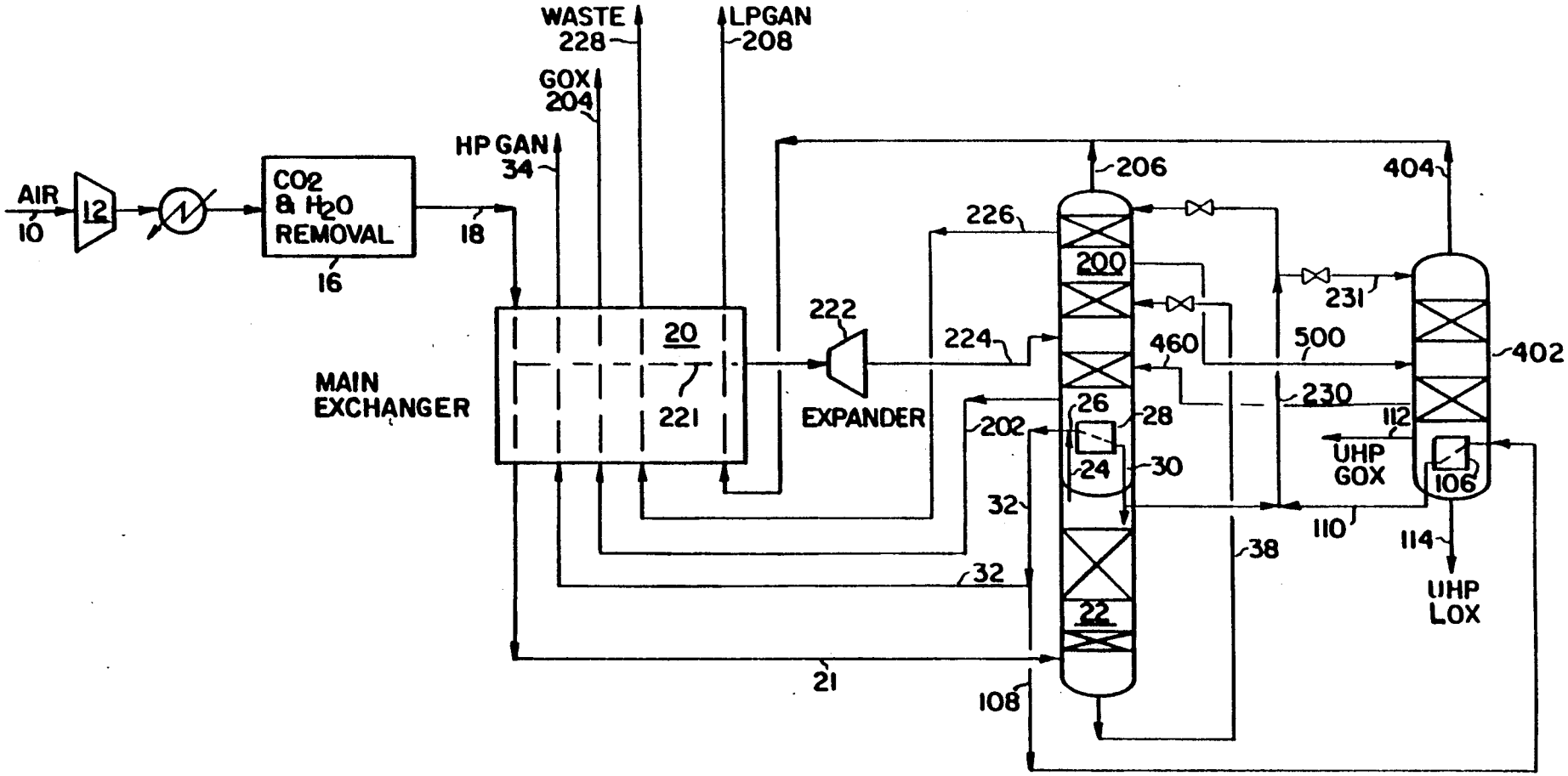
Figure 7:
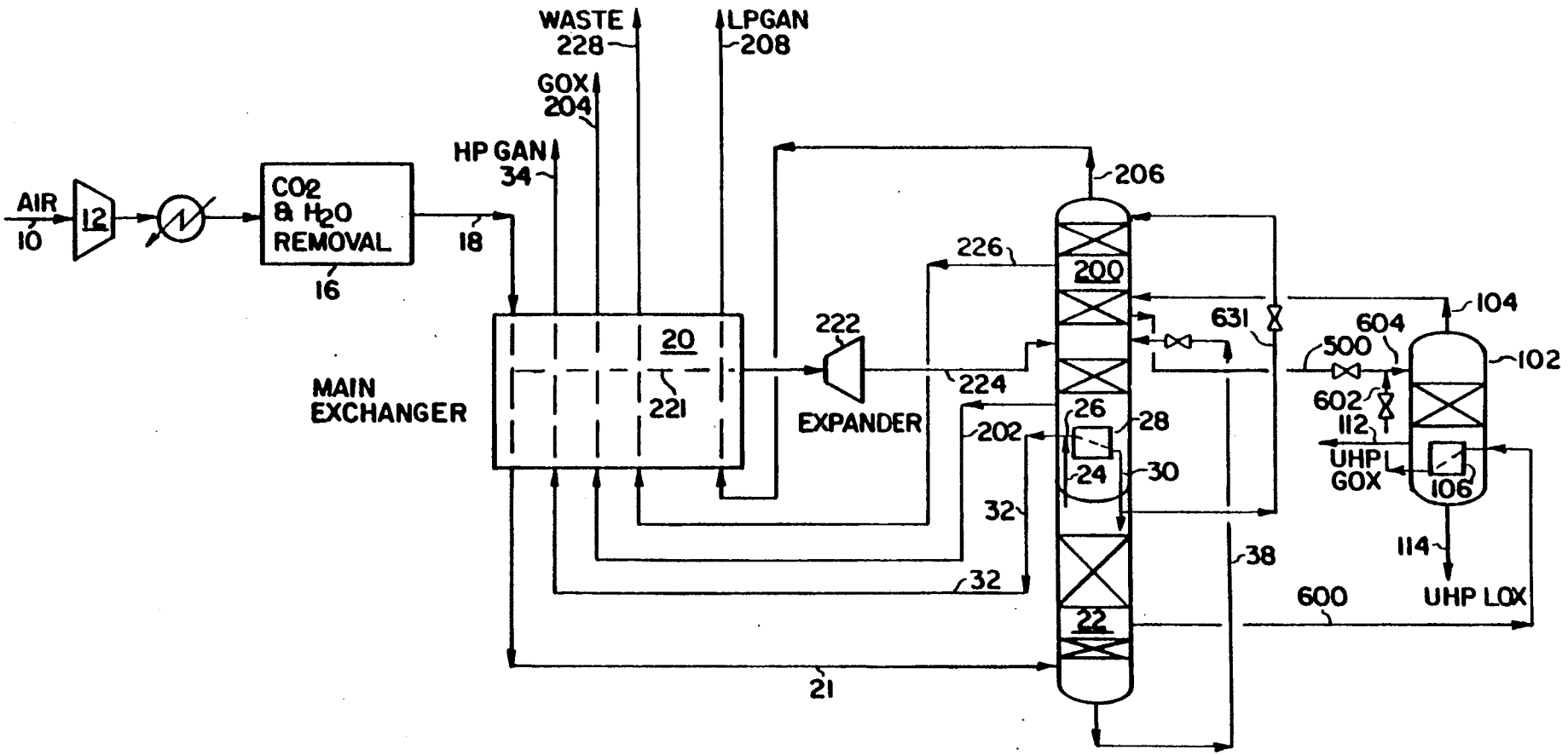

FIGS. 5–7 show flowsheets based on a vapor stream withdrawal from the high pressure or low pressure column. This vapor stream is extremely lean on heavies yet contains oxygen. A separation is performed on this vapor stream to produce ultra-high purity oxygen. These figures are discussed in further detail, as follows. As with FIGS. 1–4, common streams and equipment are identified by the same number.

In FIG. 5, a vapor stream containing oxygen is withdrawn via line 401 from high pressure column 22 a few theoretical stages above the air feed to high pressure column 22. This vapor stream, which is essentially free of heavies, is warmed in main heat exchanger 20 and expanded in turbine 403 to provide the refrigeration. The exhaust from turbine 403 is fed, via line 407, to auxiliary distillation column 402 to produce ultra-high purity oxygen. In FIG. 5 a pure liquid nitrogen stream, line 231, is used as reflux at the top of column 402. This reflux stream, line 231, is originally from the top of high pressure column 22 and is free of heavies; therefore, a pure nitrogen product is produced at the top of column 402. Alternatively, any suitable nitrogen rich but heavies-free liquid stream from the high pressure column or the low pressure column could be used as reflux to this column. In such case, vapor leaving at the top of the auxiliary column would contain quantities of oxygen and could be either fed to the low pressure column for further separation (as shown in FIG. 3 or 4) or recovered as a secondary product stream. The bottom of column 402 is reboiled by a gaseous nitrogen stream, line 108, from the top of the high pressure column. Alternatively, a portion of the feed air stream could be used for this purpose. Also in this FIG. 5, an argon-rich stream is withdrawn, via line 460, from column 402 and fed to low pressure column 200. This step is optional and is used to reduce the content of argon in the ultra-high purity oxygen. Depending on the quantities of ultra-high purity oxygen needed, either all of the expander exhaust (line 404) can be fed to column 402, via line 407, or a portion of it can be withdrawn and fed, via line 405, to low pressure column 200.

FIG. 6 is similar to FIG. 5 with only one difference. The gaseous feed to column 402 is not an expanded stream but a vapor stream withdrawn from low pressure column 200, via line 500. This vapor stream is withdrawn a few trays above the point where the topmost feed containing heavies is fed to low pressure column 200. Thus, for FIG. 6, it is withdrawn a few trays above the point where crude liquid oxygen is fed, via line 38, from the bottom of high pressure column 22 to low pressure column 200. If expanded feed air is fed above the crude liquid oxygen feed, then the vapor feed to column 402 is withdrawn a few trays above the expanded air feed to column 200. This position of withdrawal is chosen so that the heavies-free liquid reflux descending down low pressure column 200 would have sufficient trays to strip heavies contaminated vapor ascending low pressure column 200.

FIG. 7 is still another variation which can be specially useful when small quantities of ultra-high purity oxygen are required. Similar to FIG. 5, a vapor stream containing oxygen but extremely lean on heavies is withdrawn via line 600 from high pressure column 22. Rather than expanding this stream in a turbine, it is used to provide reboil for column 102. The condensed feed stream, in line 602, is reduced in pressure and fed to the top of column 102. The vapor drawn from the top of column 102 via line 104 is fed to a suitable location in the low pressure column. If liquid ultra-high purity oxygen line 114 is to be produced, then an additional liquid feed stream is needed. This stream, which is heavies-free is withdrawn, via line 500, from low pressure column 200 and fed to the top of column 102.

In FIG. 4, where a liquid stream from the low pressure column is fed to the auxiliary column for the separation and production of ultra-high purity oxygen, the concentration of oxygen in this heavies-free liquid feed stream is typically less than 35%. For the recovery of ultra-high purity oxygen to be meaningful, it is desirable that this oxygen concentration be higher than 1%. These limits of oxygen concentration would also be applicable to liquid withdrawal from the high pressure column (FIGS. 1–3). The typical concentration range of oxygen will be 5% to 25%. The upper limit of about 35% oxygen will also be true for the liquid feed, line 500, in FIG. 7, however, there is no lower limit and the stream could be pure liquid nitrogen.

For the cases where gaseous stream is withdrawn either from the high pressure column or the low pressure column and fed to the auxiliary column for the production of ultra-high purity oxygen (FIGS. 5–7), the concentration of oxygen in this vapor stream will be less than 20%. The most likely concentration of oxygen will be in the range of 3% to 15%. A concentration of oxygen less than 1% will be undesirable due to extremely low production rates of ultra-high purity oxygen.

Embodiment #2

Embodiment #1 discussed the withdrawal of a heavies-free, oxygen-containing stream from the main column systems (high pressure and/or low pressure columns) and then feeding it to an auxiliary column to recover ultra-high purity oxygen. Embodiment #2 is a method whereby a heavies-free but oxygen-containing stream is created from heavies containing crude liquid oxygen of the high pressure column and then fed to an auxiliary column for the production of ultra-high purity oxygen. This embodiment #2 decreases the amount of heavies-free but oxygen containing-stream withdrawn from the main column system and thereby decreases the impact of such withdrawal on the nitrogen recovery. This embodiment is specially useful for high pressure nitrogen plants.

Figure 8:
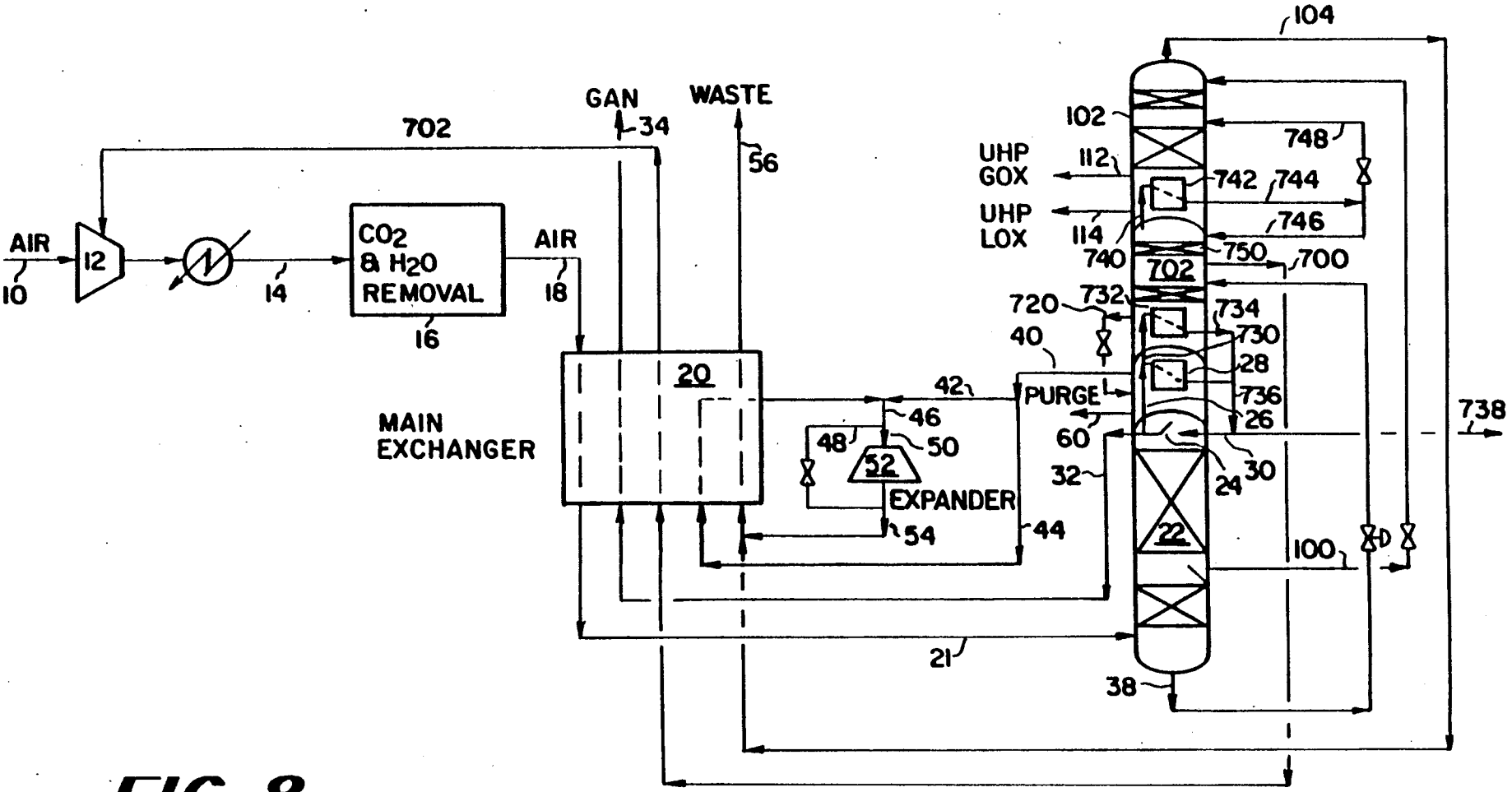

This idea can be described in detail with reference to FIGS. 8–10. FIG. 8 shows a modification of a double column dual reboiler high pressure nitrogen generator with waste expander. In this nitrogen generator, the crude liquid oxygen stream from the bottom of main column 22 (high pressure column) is fed, via line 38, at the top of column 702 operating at a lower pressure. Boilup at the bottom of low pressure column 702 is provided by condensing a portion of the nitrogen line 730 from main column 22. The vapor from the top of column 702 is recycled via lines 700 and 702 to an intermediate stage of main air compressor 12. The unboiled liquid line 720 from the bottom of column 702 is reduced in pressure and reboiled in second reboiler/condenser 28 against condensing nitrogen line 26 from main distillation column 22. The vapor line 40 from second reboiler/condenser 28 is warmed and expanded in a turbo-expander to provide the needed refrigeration. This process can be modified to produce ultra-high purity oxygen. In the modification, some trays are added as section 750 to column 702 above the crude liquid oxygen feed through line 38 and the top of column 702 is thermally linked with the bottom of the column 102 producing ultra-high purity oxygen through reboiler/condenser 742. A liquid stream which is extremely lean on heavies but contains sufficient quantity of oxygen can be withdrawn via line 100 from main nitrogen column 22 and fed to the top section of column 102. Crude liquid oxygen from the bottom of main nitrogen column 22 is fed via line 38 to an intermediate section of column 702. A vapor stream is withdrawn via line 700 from an intermediate location of column 702 for recycle. The vapor at the top of column 702, line 740, is condensed in reboiler/condenser 742 by providing the heat duty for reboiling column 102. A portion of this condensed stream line 744 is returned via line 746 as reflux to column 702. Due to this reflux, the vapor ascending in the top section of column 702 is cleaned of heavies and therefore when this vapor, line 740, is condensed, it is free of heavies. The remaining portion of condensed heavies-free stream, line 744, is fed via line 748 to the top section of column 102 as secondary source of oxygen. In FIG. 8, stream 748 is fed a couple of trays below stream 100; the position of these streams would change depending on the concentration of oxygen in each of the streams.

This method of adding additional trays as a top section to column 702 and thermally linking its top with the bottom of column 102 allows one to create an additional heavies-free oxygen source from the crude liquid oxygen. Therefore, for a given quantity of ultra-high purity oxygen to be produced, this embodiment decreases the amount of heavies-free and oxygen containing liquid to be withdrawn via line 100 from main nitrogen column 22. This processing step reduces any detrimental effect on the nitrogen recovery because as the flow of stream 100 is decreased the liquid reflux in the bottom section of main column 22 is increased.

The essence of this embodiment #2 is that if the crude liquid oxygen is boiled in a reboiler/condenser against a condensing nitrogen stream and if the pressure of the nitrogen stream is sufficiently high, then the vaporized stream is at sufficient pressure so that a portion of it can be recondensed against ultra-high purity liquid oxygen at the bottom of the auxiliary column. This recondensed liquid is then split into two fractions. One fraction is used as reflux to the short column to provide heavies-free vapor stream to be recondensed against ultra-high purity liquid oxygen. The second fraction forms the feed to the auxiliary column to produce ultra-high purity oxygen.

Figure 9:
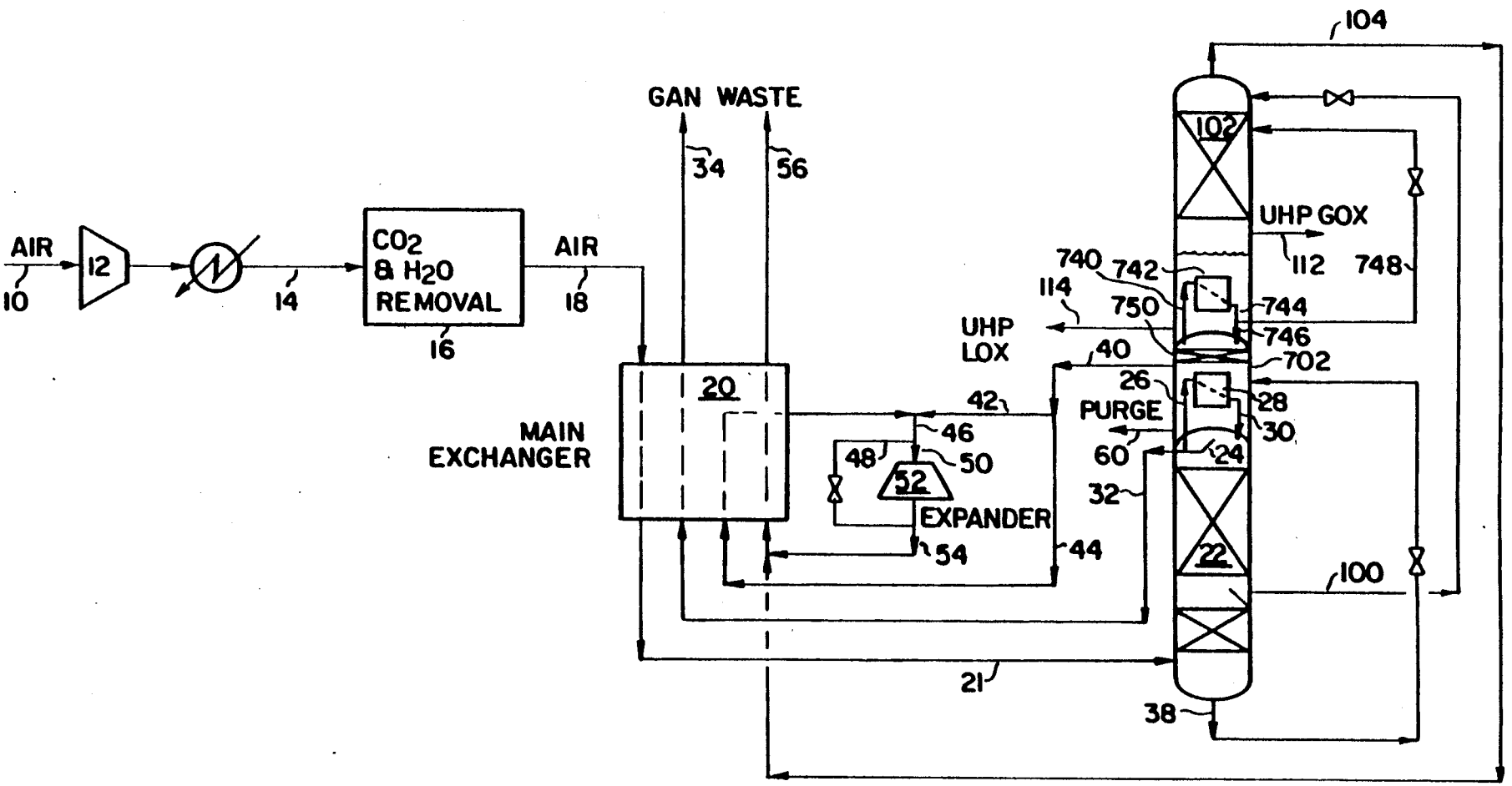

To demonstrate the general applicability of this concept, a simplified version of FIG. 8 is shown in FIG. 9. In FIG. 9, nitrogen line 26 from the top of main column 22 is condensed in single reboiler/condenser 28 (usual single column waste expander nitrogen generator). A few trays 750 are added above reboiler/condenser 28, in essence creating column 702. A portion of the vaporized crude liquid oxygen ascends this column and is cleaned of the heavies by the descending liquid. The heavies-free vapor line 740 is condensed in reboiler/condenser 742 by boiling the bottom of column 102. A portion of this condensed liquid is sent via line 746 as reflux to column 702 to clean the ascending vapor of the heavies. The remaining portion of the condensed liquid line 748 forms a part of the feed to column 102 and is fed at a suitable location in the top section of column 102.

Figure 10:
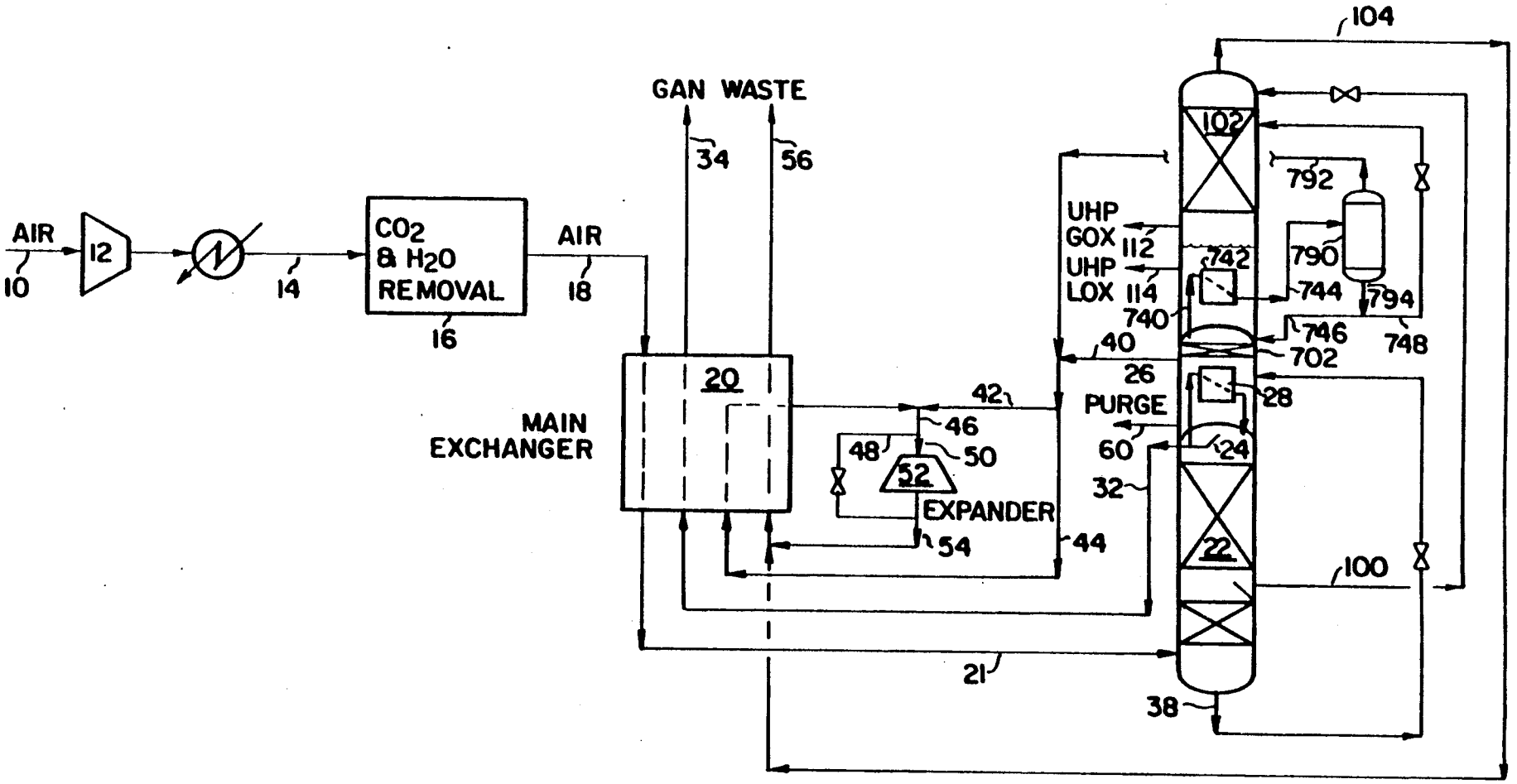

In FIGS. 8 and 9, if the pressure of product nitrogen line 24 is such that the vaporized crude liquid oxygen is unable to condense totally in the reboiler/condenser located at the bottom of the auxiliary column then partial condensation can be utilized as shown in FIG. 10. In reference to FIG. 10, heavies-free stream line 740, is partially condensed in reboiler/condenser 742 located at the bottom of column 102 producing a mixed stream. This partially condensed stream is then fed via line 744 to separator 790, thereby producing a vapor overhead and a liquid bottom. The liquid bottom, line 794, is handled in the same manner as condensed stream 744 in FIGS. 8 and 9. The vapor overhead is mixed via line 792 with the oxygen-rich waste in line 40 from the bottom of column 702. In another alternative, this vapor overhead, line 792, could be let down in pressure and fed to a suitable location in column 102. This will specially be beneficial if the liquid stream is withdrawn via line 100 from main nitrogen column 22 (high pressure column) can be fed to column 102 a few trays above the vapor feed location where 792 is fed so that it can provide the suitable reflux to recover some oxygen from vapor feed 792.

In FIGS. 8–10, the concentration of oxygen in stream 740 to be condensed in reboiler/condenser 742 located at the bottom of column 102 will be less than 35%. Thus, stream 748 recovered from the crude liquid oxygen and then fed as additional feed to column 102 will have oxygen concentration less than 35% and typically is in the range of 5% to 25% oxygen. Because of this additional feed to the auxiliary column, the liquid feed stream 100 withdrawn from the main nitrogen column 22 can have extremely low concentrations of oxygen; so much so that it could be a liquid nitrogen stream withdrawn from the top of column 22. Therefore, stream 748 can be the only source of oxygen to column 102 and liquid feed 100 from main nitrogen column 22 (high pressure column) should be fed a couple of trays above this feed stream. This arrangement reduces the oxygen content in the vapor stream leaving from the top of column 102.

Embodiment #3

For double column (classical Linde arrangement of columns), cycles producing nitrogen and oxygen, FIGS. 3–7 shows schemes to produce ultra-high purity oxygen according to Embodiment #1. In these schemes, feeds to the auxiliary column have oxygen concentrations less than 35%. These feeds are drawn either from a suitable location in the top section of the low pressure column or from a suitable tray in the high pressure column. The current embodiment suggests a method of producing ultra-high purity oxygen from a stream withdrawn from the bottom section of the low pressure column and is particularly useful for cases where argon is coproduced along with nitrogen and oxygen. This embodiment will be illustrated through three flowsheets (FIGS. 10–12).

Figure 11:
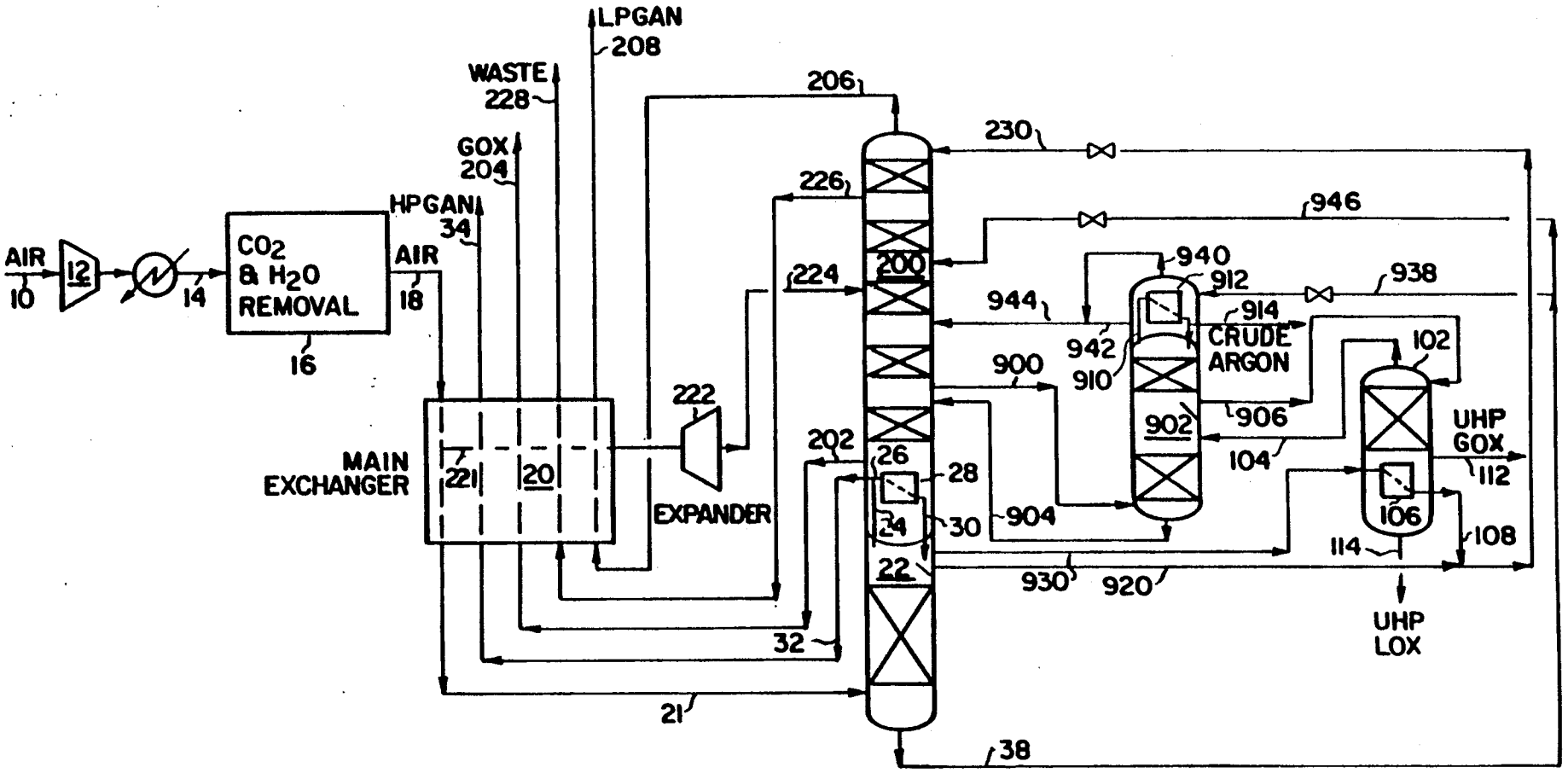

FIG. 11 demonstrates the basic idea. With references to FIG. 11, flow streams which are identical to earlier figures are assigned common numbers. Describing the new section, a vapor stream is fed via line 900 to the bottom of side arm column 902, such stream contains heavies. However, these will be stripped as the stream ascends side arm 902 by liquid descending down the column. The heavies leave side arm column 902 at the bottom via line 904 and the heavies-laden stream is returned to column 200. Thus a few trays above the bottom of the side arm column neither the vapor nor liquid have any appreciable quantities of heavies. Therefore, an opportunity is provided to withdraw a suitable stream from side arm column 902 and rectify the withdrawn stream in an auxiliary column to produce ultra-high purity oxygen. In FIG. 11, a liquid stream is withdrawn via line 906 from an intermediate location of side arm column 902 and fed to the top of auxiliary column 102. Typically, the vapor feed stream in line 900 to side arm column 902 contains about 7% to 20% argon, 1-500 ppm of nitrogen and the residual is oxygen and heavier materials. Therefore, the liquid feed stream in line 906 to auxiliary column 102 will contain less than 90% oxygen, ppm levels of nitrogen and the balance argon. The practical concentration of oxygen in this stream will be in the range of 5% to 85% oxygen. Boilup at the bottom of auxiliary column 102 is provided by condensing nitrogen, in line 930, from the top of high pressure column 22. Alternatively, boilup could be provided by condensing a portion of the feed air stream. Ultra-high purity, oxygen is produced from the bottom of auxiliary column in line 112 and/or line 114. The vapor from the top of column 102 is returned via line 104 to side arm column 902. This present method of producing ultra-high purity oxygen is very efficient because the feed, line 906, to auxiliary column 102 is not only heavies-free but is also rich in oxygen and therefore, a short auxiliary column is only needed to provide ultra-high purity oxygen.

Figure 12:
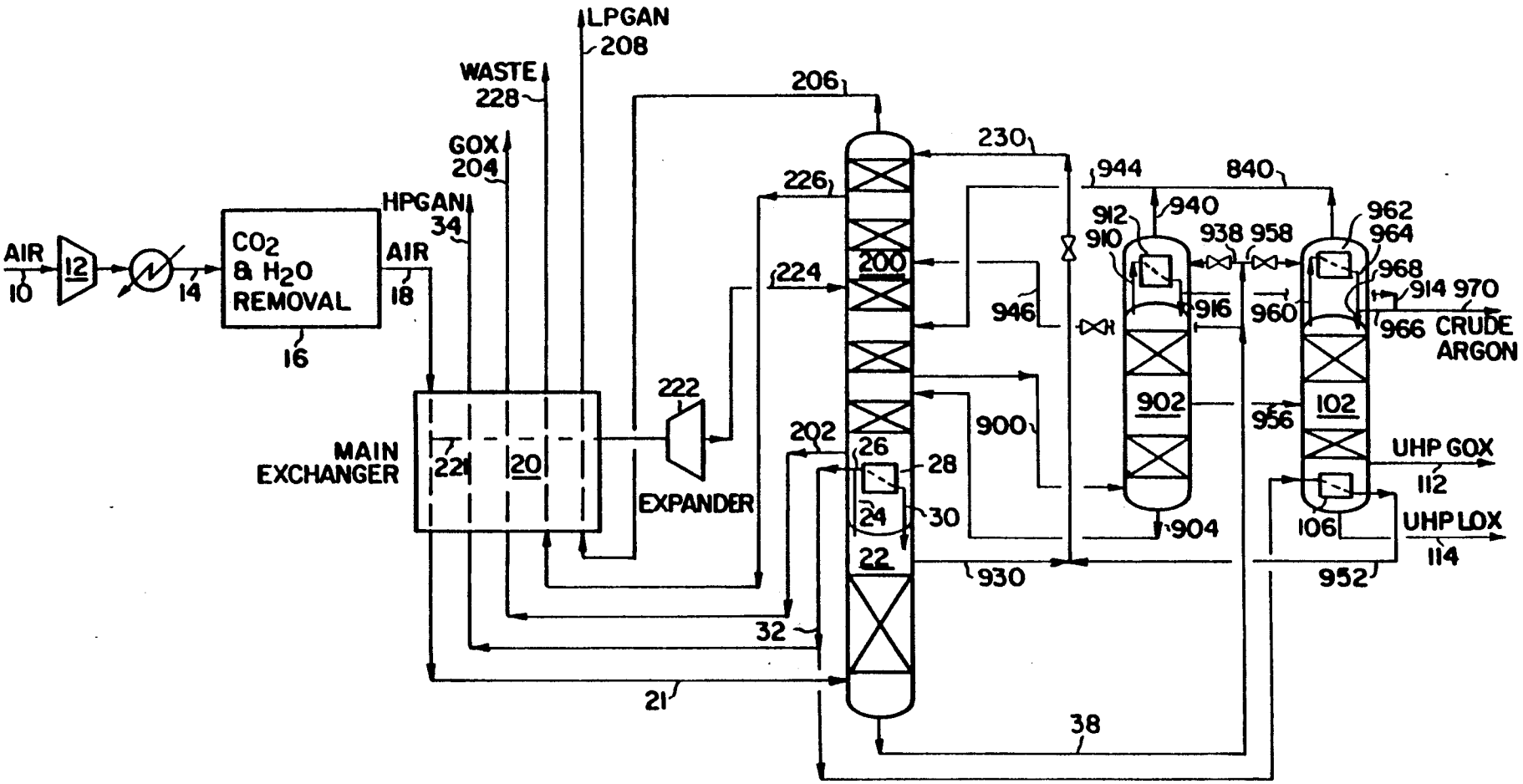

In another variation of this approach, FIG. 12, a vapor stream is withdrawn via line 956 from an intermediate location of side arm column 902 and fed to an intermediate location of auxiliary column 102. In this variation, auxiliary column 102 has reboiler/condenser 962 at the top to condense the ascending vapor line 960 and provide the reflux line 968 to this column. Also, a portion of the crude argon product line 966 is also produced from column 102. Similar to side arm column 902 reboiler/condenser 912, a portion of the crude liquid oxygen, line 958, is vaporized in reboiler/condenser 962 of auxiliary column 102. The rest of the process is similar to FIG. 11.

Figure 13:
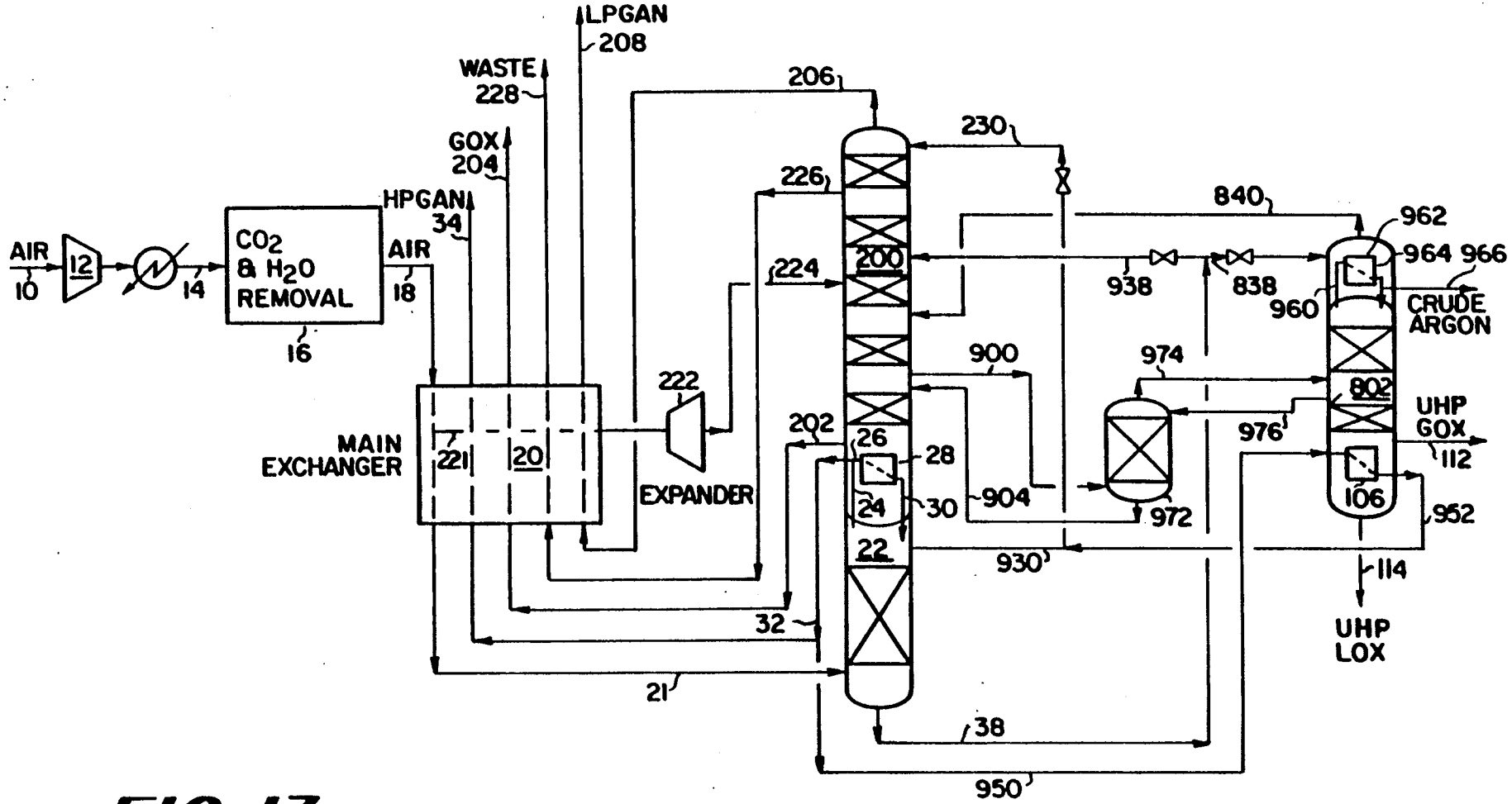

The flowsheet of FIG. 12 is a little cumbersome in the sense that an additional reboiler/condenser and additional trays in the top section of the auxiliary column are required. This problem is easily solved by the process of FIG. 13. In this process, vapor from the low pressure column is fed via line 900 to "short" column 972. The objective of column 972 is to clean the ascending vapor of heavies by the descending liquid stream. The liquid stream from column 972 is returned via line 904 to low pressure column 200. The heavies-free vapor from the top of column 972 is fed via line 974 to an intermediate location of modified side arm/auxiliary column 802. The vapor ascending in the rectifying section of column 802 is enriched in argon. Reflux is provided to column 802 in a manner similar to any side arm column arrangement. The bottom of column 802 is reboiled with either nitrogen via line 950 from the top of the high pressure column or alternatively with a portion of the high pressure feed air stream. The liquid stream descending the stripping section of this column is enriched in oxygen and ultra-high purity oxygen is produced via line 112 from the bottom of column 802. At an intermediate location of column 802 a liquid stream is withdrawn and is fed via line 976 as reflux stream to "short" column 972 to clean the ascending vapor of the heavies. The process of FIG. 13 will be similar to the process of FIG. 11 in performance. Once again the vapor feed line 974 to modified side arm/auxiliary column 802 will contain about 5% to 85% oxygen.

In an attempt to generalize this approach to the cases where large recovery of argon is not crucial, a stream can be withdrawn from the low pressure column at any suitable location, thus, the concentration of oxygen in this stream could be as high as 99%. However, it may be desirable to avoid withdrawal of this stream from the bottom most locations of the low pressure column as it will be richest in the heavies. Even so, in these cases, the process of FIGS. 11-13 will produce an argon enriched stream leaving at the top location of the side arm column or the modified side arm/auxiliary column as "crude argon." However, now it is not essential to obtain extremely high concentrations of argon in this "crude argon" product.

The present invention has been described with reference to several embodiments thereof. These embodiments should not be viewed as limitations on the present invention, such limitations being ascertained by the following claims.

We claim:

1. In a process for the fractionation of air by cryogenic distillation using a thermally integrated dual-column cryogenic distillation system comprising a high pressure distillation column and a low pressure distillation column, wherein a feed air stream is compressed, cooled to near its dew point and fed to the high distillation column system for rectification thereby producing a nitrogen containing overhead and a crude liquid oxygen bottoms and wherein the crude liquid oxygen is reduced in pressure, fed to and further fractionated in the low pressure distillation column thereby producing a low pressure nitrogen overhead, the improvement for producing an ultra-high purity oxygen product comprising the steps of: removing an oxygen-containing stream from a location of the thermally integrated dual-column cryogenic distillation system where the removed stream is essentially free of heavier contaminants comprising hydrocarbons, carbon dioxide, xenon and krypton, and subsequently stripping the removed oxygen-containing stream in a cryogenic stripping/distillation column thereby producing an ultra-high purity oxygen product at the bottom of the cryogenic stripping/distillation column.

2. The process according to claim 1, wherein the removed oxygen-containing stream to be stripped is removed as a liquid stream.

3. The process according to claim 1, wherein the removed oxygen-containing stream to be stripped is removed as a vapor stream.

4. The process according to claim 1, wherein the removed oxygen-containing stream to be stripped is removed from the low pressure column.

5. The process according to claim 1, wherein the removed oxygen-containing stream to be stripped is removed from the high pressure column.

6. The process according to claim 1, wherein heat duty to provide reboil to the cryogenic stripping/distillation column is provided by at least partially condensing a portion of the nitrogen overhead from the distillation column of the cryogenic distillation system.

7. In a process for the fractionation of air by cryogenic distillation using a cryogenic distillation column system comprising a high pressure distillation column and a low pressure distillation column, which comprise a dual-column portion of the cryogenic distillation column system, and an argon side-arm distillation column, wherein a feed air stream is compressed, cooled to near its dew point and fed to the high pressure distillation column system for rectification thereby producing a nitrogen containing overhead and a crude liquid oxygen bottoms; wherein the crude liquid oxygen is reduced in pressure, fed to and further fractionated in the low pressure distillation column thereby producing a low pressure nitrogen overhead; and wherein an argon-containing side stream is removed from the low pressure column and rectified in the argon side-arm distillation column thereby producing a crude argon overhead and an enriched oxygen liquid which is returned to the low pressure column, the improvement for producing an ultra-high purity oxygen product comprising the steps of: removing an oxygen-containing stream from a location of the dual-column portion of the cryogenic distillation column system where the removed stream is essentially free of heavier contaminants comprising hydrocarbons, carbon dioxide, xenon and krypton, and subsequently stripping the removed oxygen-containing stream in a cryogenic stripping/distillation column thereby producing an ultra-high purity oxygen product at the bottom of the cryogenic stripping/distillation column.

8. The process according to claim 7, wherein the removed oxygen-containing stream to be stripped is removed as a liquid stream.

9. The process according to claim 7, wherein the removed oxygen-containing stream to be stripped is removed as a vapor stream.

10. The process according to claim 7, wherein the removed oxygen-containing stream to be stripped is removed from the low pressure column.

11. The process according to claim 7, wherein the removed oxygen-containing stream to be stripped is removed from the high pressure column.

12. The process according to claim 7, wherein the removed oxygen-containing stream to be stripped is removed from the argon side-arm column.

13. The process according to claim 7, wherein heat duty to provide reboil to the cryogenic stripping/distillation column is provided by at least partially condensing a portion of the nitrogen overhead from the high pressure distillation column of the cryogenic distillation system.

14. In a process for the fractionation of air by cryogenic distillation using a single (nitrogen generator) distillation column, wherein a feed air stream is compressed, cooled to near its dew point and fed to the distillation column system for rectification thereby producing a nitrogen containing overhead and a crude liquid oxygen bottoms, the improvement for producing an ultra-high purity oxygen product comprising the steps of: rectifying the crude liquid bottoms thereby producing an oxygen-containing stream which is essentially free of heavier contaminants comprising hydrocarbons, carbon dioxide, xenon and krypton, and subsequently stripping the oxygen-containing stream in a cryogenic stripping/distillation column thereby producing an ultra-high purity oxygen product at the bottom of the cryogenic stripping/distillation column, and refluxing said cryogenic stripping/distillation column with a liquid stream from the distillation column which is essentially free of heavier components comprising hydrocarbons, carbon dioxide, xenon and krypton.

15. The process according to claim 14, wherein heat duty to provide reboil to the cryogenic stripping/distillation column is provided by condensing at least a portion of the oxygen-containing stream prior to rectification.

16. In a process for the fractionation of air by cryogenic distillation using a cryogenic distillation column system comprising a high pressure distillation column, a low pressure distillation column and an argon side-arm distillation column, wherein a feed air stream is compressed, cooled to near its dew point and fed to the high pressure distillation column system for rectification thereby producing a nitrogen containing overhead and a crude liquid oxygen bottoms; wherein the crude liquid oxygen is reduced in pressure, fed to and further fractionated in the low pressure distillation column thereby producing a low pressure nitrogen overhead; and wherein an argon-containing side stream is removed from the low pressure column and rectified in the argon side-arm distillation column thereby producing a crude argon overhead and an enriched oxygen liquid which is returned to the low pressure column, the improvement for producing an ultra-high purity oxygen product comprising the steps of: rectifying the argon-containing side stream to remove heavy comtaminants comprising hydrocarbons, carbon dioxide, xenon and krypton prior to rectification in the argon side-arm distillation and subsequently stripping the produced enriched oxygen liquid thereby producing an ultra-high purity oxygen product.

* * * * *